US009633800B1

(12) United States Patent
Tsai et al.

(10) Patent No.: US 9,633,800 B1
(45) Date of Patent: Apr. 25, 2017

(54) KEY STRUCTURE

(71) Applicant: Primax Electronics Ltd., Neihu, Taipei (TW)

(72) Inventors: Lei-Lung Tsai, Taipei (TW); Yi-Shu Lee, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/077,818

(22) Filed: Mar. 22, 2016

(30) Foreign Application Priority Data

Feb. 19, 2016 (TW) ..... 105105024 A

(51) Int. Cl.
*H01H 3/12* (2006.01)
*H01H 13/14* (2006.01)
*H01H 13/705* (2006.01)

(52) U.S. Cl.
CPC ..... *H01H 3/122* (2013.01); *H01H 13/14* (2013.01); *H01H 13/705* (2013.01)

(58) Field of Classification Search
CPC ..... H01H 3/122; H01H 13/14; H01H 13/705
USPC ..... 200/517, 5 A, 512–516, 314, 341–345, 200/520
See application file for complete search history.

(56) References Cited

U.S. PATENT DOCUMENTS 6,057,522 A * 5/2000 Chao ..... H01H 3/122 200/341
6,100,482 A * 8/2000 Koma ..... H01H 3/122 200/344
2014/0367240 A1* 12/2014 Lin ..... H01H 3/125 200/5 A

* cited by examiner

*Primary Examiner* — Edwin A. Leon
(74) *Attorney, Agent, or Firm* — Kirton McConkie; Evan R. Witt

(57) ABSTRACT

A key structure includes a base, a keycap, a first longitudinal bar, a second longitudinal bar, a first transverse bar and a second transverse bar. The first longitudinal bar, the second longitudinal bar, the first transverse bar and the second transverse bar are uniformly distributed in the range of the keycap. Consequently, the keycap is stably moved relative to the base. The first longitudinal bar, the second longitudinal bar, the first transverse bar and the second transverse bar are made of a metallic material. Since these bars are thinner than the scissors-type connecting element of the conventional key structure, the key structure of the present invention has reduced thickness. Moreover, since these bars are made of the metallic material, the structural strength of the key structure is increased.

11 Claims, 7 Drawing Sheets

KEY STRUCTURE

FIELD OF THE INVENTION

The present invention relates to a key structure, and more particularly to a key structure without a scissors-type connecting element.

BACKGROUND OF THE INVENTION

Generally, the widely-used peripheral input device of a computer system includes for example a mouse, a keyboard, a trackball, or the like. Via the keyboard, characters or symbols can be directly inputted into the computer system. As a consequence, most users and most manufacturers of input devices pay much attention to the development of keyboards. As known, a keyboard with scissors-type connecting elements is one of the widely-used keyboards.

Hereinafter, a key structure with a scissors-type connecting element of a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base 15. The keycap 11, the scissors-type connecting element 12, the rubbery elastomer 13 and the membrane switch circuit member 14 are supported by the base 15. The scissors-type connecting element 12 is used for connecting the base 15 and the keycap 11.

The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The scissors-type connecting element 12 is arranged between the base 15 and the keycap 11, and the base 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base 15. The rubbery elastomer 13 is enclosed by the scissors-type connecting element 12. Moreover, the first frame 121 comprises a first keycap post 1211 and a first base post 1212. The first frame 121 is connected with the keycap 11 through the first keycap post 1211. The first frame 121 is connected with the base 15 through the first base post 1212. The second frame 122 is combined with the first frame 121. A first end of the second frame 122 is connected with the base 15. A second end of the second frame 122 is connected with the keycap 11. Moreover, the second frame 122 comprises a second keycap post 1221 and a second base post 1222. The second frame 122 is connected with the keycap 11 through the second keycap post 1221. The second frame 122 is connected with the base 15 through the second base post 1222.

The operations of the conventional key structure 1 in response to the depressing action of the user will be illustrated as follows. Please refer to FIG. 1 again. When the keycap 11 is depressed by the user, the keycap 11 is moved downwardly to push the scissors-type connecting element 12 in response to the depressing force. As the keycap 11 is moved downwardly relative to the base 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11, and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

Recently, the general trends of designing electronic devices and their peripheral devices are toward slimness, light weightiness an easy portability. Consequently, keyboards and other peripheral devices need to meet the requirements of slimness. For achieving this purpose, the manufacturers make efforts in minimizing the thicknesses of some or all components of the key structure. Under this circumstance, the structural strength of the key structure is impaired, and thus the key structure is easily damaged. Moreover, the tactile feel of depressing the key structure is deteriorated.

Therefore, there is a need of providing a key structure with slimness and increased structured strength.

SUMMARY OF THE INVENTION

The present invention provides a key structure with slimness and increased structured strength.

In accordance with an aspect of the present invention, there is provided a key structure. The key structure includes a base, a keycap, a first longitudinal bar, a second longitudinal bar, a first transverse bar and a second transverse bar. The keycap is disposed over the base, and movable relative to the base. The first longitudinal bar is connected with the keycap and the base, and located at a first side of the keycap. The second longitudinal bar is connected with the keycap and the base, and located at a second side of the keycap. The first transverse bar is connected with the keycap and the base, and located at a third side of the keycap. A first end of the first transverse bar is overlapped with the first longitudinal bar. A second end of the first transverse bar is overlapped with the second longitudinal bar. The second transverse bar is connected with the keycap and the base, and located at a fourth side of the keycap. A first end of the second transverse bar is overlapped with the first longitudinal bar. A second end of the second transverse bar is overlapped with the second longitudinal bar. While the keycap is depressed, the first transverse bar and the second transverse bar are pushed by the keycap, and the first longitudinal bar and the second longitudinal bar are pushed by the first transverse bar and the second transverse bar, so that the keycap is moved relative to the base.

From the above descriptions, the present invention provides the key structure. The first longitudinal bar, the second longitudinal bar, the first transverse bar and the second transverse bar are made of a metallic material. Moreover, the first longitudinal bar, the second longitudinal bar, the first transverse bar and the second transverse bar are uniformly distributed in the range of the keycap in order to replace the scissors-type connecting element of the conventional key structure. Since the first longitudinal bar, the second longitudinal bar, the first transverse bar and the second transverse bar are thinner than the scissors-type connecting element of the conventional key structure, the key structure of the present invention has reduced thickness. Consequently, the key structure has slim appearance. Moreover, since the first longitudinal bar, the second longitudinal bar, the first transverse bar and the second transverse bar are made of the metallic material, the structural strength of the key structure is increased. In other words, the use of the key structure of present invention can overcome the drawbacks of the conventional technologies.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure with increased structural strength and slim appearance.

Figure 1:
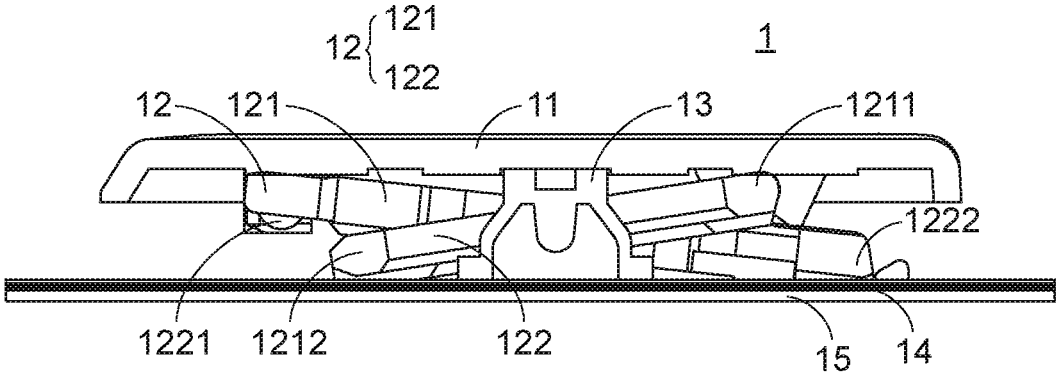
FIG.1 PRIOR ART
FIG. 1 is a schematic side cross-sectional view illustrating a conventional key structure.
Figure 2:
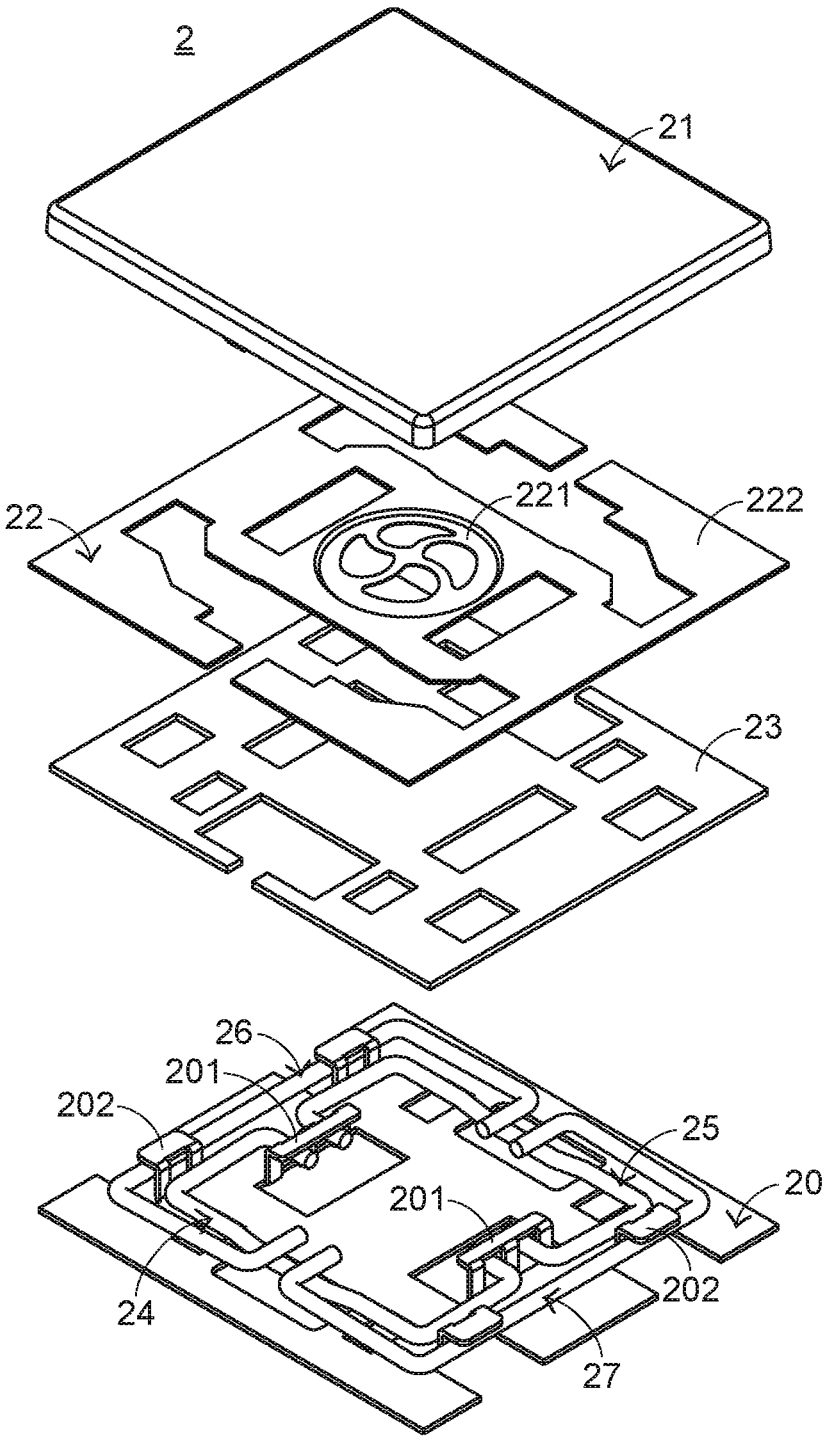
FIG. 2 is a schematic exploded view illustrating a key structure according to an embodiment of the present invention.
Figure 3:
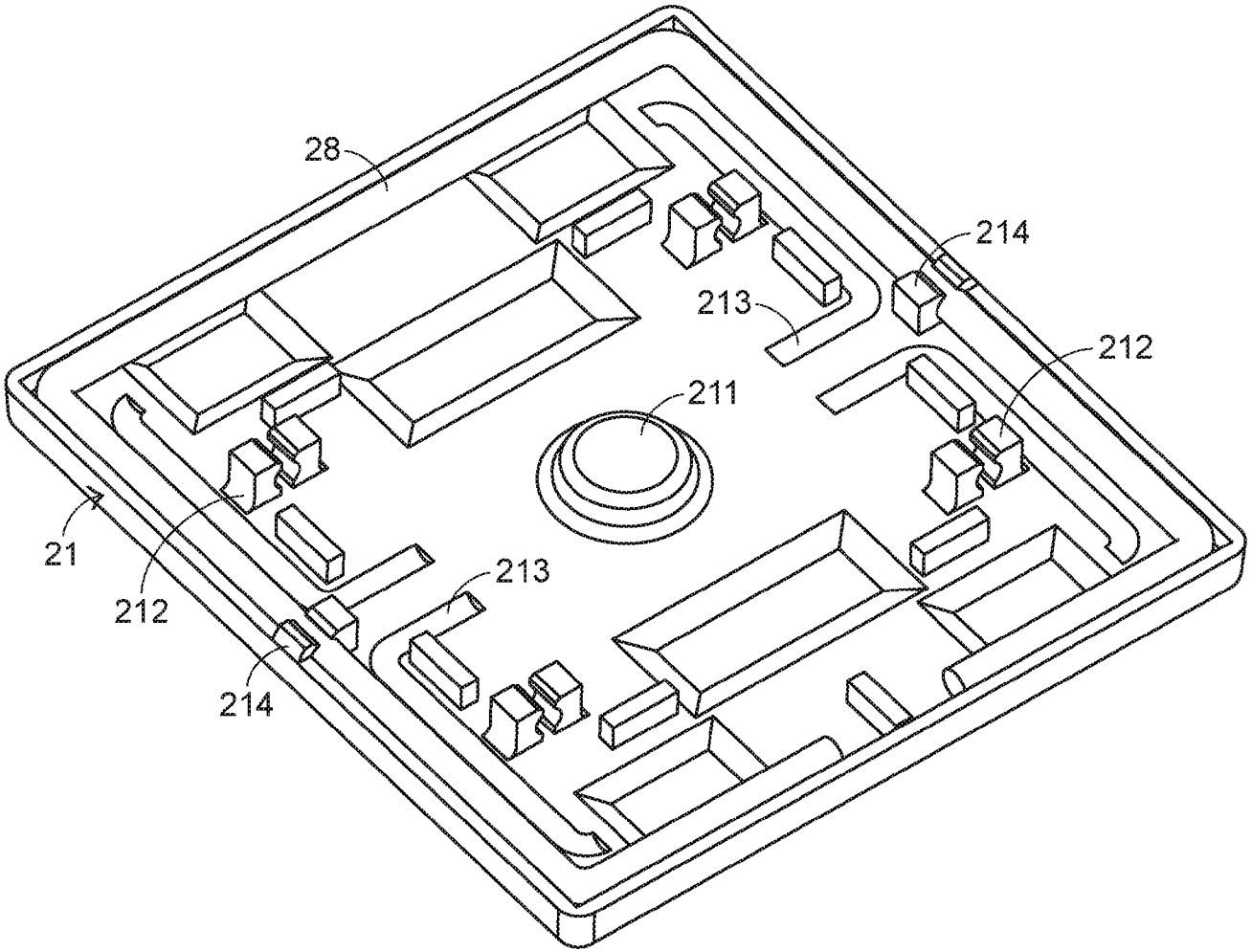
FIG. 3 is a schematic perspective view illustrating the keycap of the key structure according to the embodiment and taken along another viewpoint.

FIG. 2 is a schematic exploded view illustrating a key structure according to an embodiment of the present invention. FIG. 3 is a schematic perspective view illustrating the keycap of the key structure according to the embodiment and taken along another viewpoint. As shown in FIGS. 2 and 3, the key structure 2 comprises a base 20, a keycap 21, an elastic element 22, a membrane switch circuit member 23, a first longitudinal bar 24, a second longitudinal bar 25, a first transverse bar 26, a second transverse bar 27 and a surrounding bar 28. The keycap 21 is disposed over the base 20, and movable relative to the base 20. The keycap 21 comprises a protrusion part 211, plural first keycap hooks 212, plural receiving grooves 213 and plural second keycap hooks 214. The protrusion part 211 is protruded externally from an inner surface of the keycap 21. As shown in FIG. 2, the protrusion part 211 is protruded downwardly from the inner surface of the keycap 21. The plural first keycap hooks 212 and the plural second keycap hooks 214 are protruded from the inner surface of the keycap 21. The plural receiving grooves 213 are formed in the inner surface of the keycap 21. The plural second keycap hooks 214 are disposed on a periphery region of the inner surface of the keycap 21. Moreover, the plural second keycap hooks 214 are connected with the surrounding bar 28. Consequently, the surrounding bar 28 surrounds the periphery region of the inner surface of the keycap 21, and the structural strength of the keycap 21 is increased. In this embodiment, the surrounding bar 28 is made of a metallic material, and the surrounding bar 28 substantially has a rectangular hollow shape.

The base 20 comprises plural first base hooks 201 and plural second base hooks 202. The plural first base hooks 201 and the plural second base hooks 202 are protruded from a surface of the base 20. The membrane switch circuit member 23 is disposed on the base 20. As the keycap 21 is moved downwardly, a key signal corresponding to the keycap 21 is outputted from the membrane switch circuit member 23. The structure of the membrane switch circuit member 23 is substantially identical to that of the conventional membrane switch circuit member, and is not redundantly described herein. The elastic element 22 is arranged between the keycap 21 and the membrane switch circuit member 23. When the elastic element 22 is pushed by the keycap 21, the membrane switch circuit member 23 is triggered. In this embodiment, the elastic element 22 comprises a rubbery elastomer 221 and an elastic sheet 222. The rubbery elastomer 221 is aligned with the corresponding keycap 21. In practice, plural rubbery elastomers 221 are coupled with the elastic sheet 222. For clarification and brevity, only one rubbery elastomer 221 is shown in FIG. 2.

Figure 4:
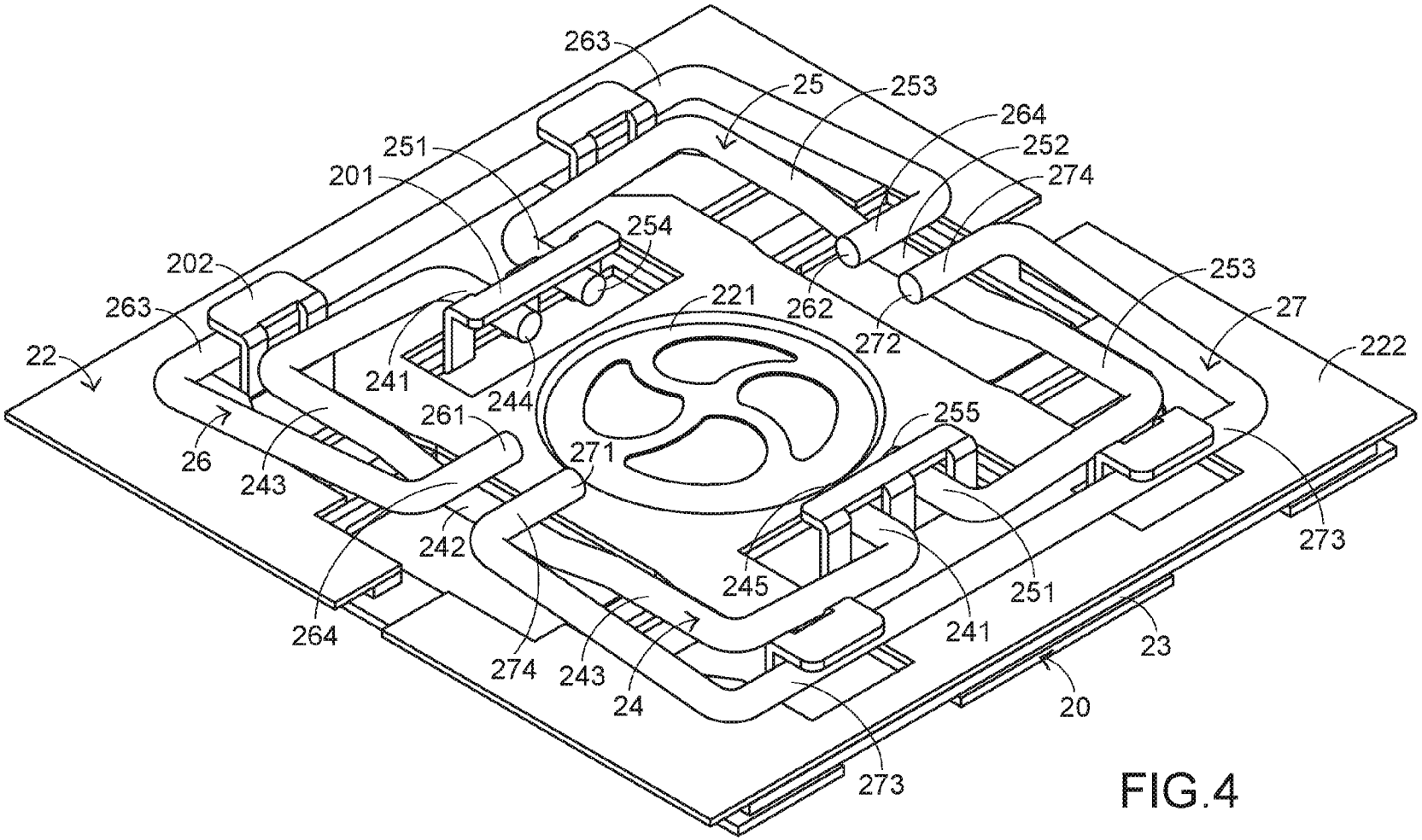
FIG. 4 is a schematic assembled view illustrating a portion the key structure according to the embodiment of the present invention, in which the keycap is not shown.
Figure 5:
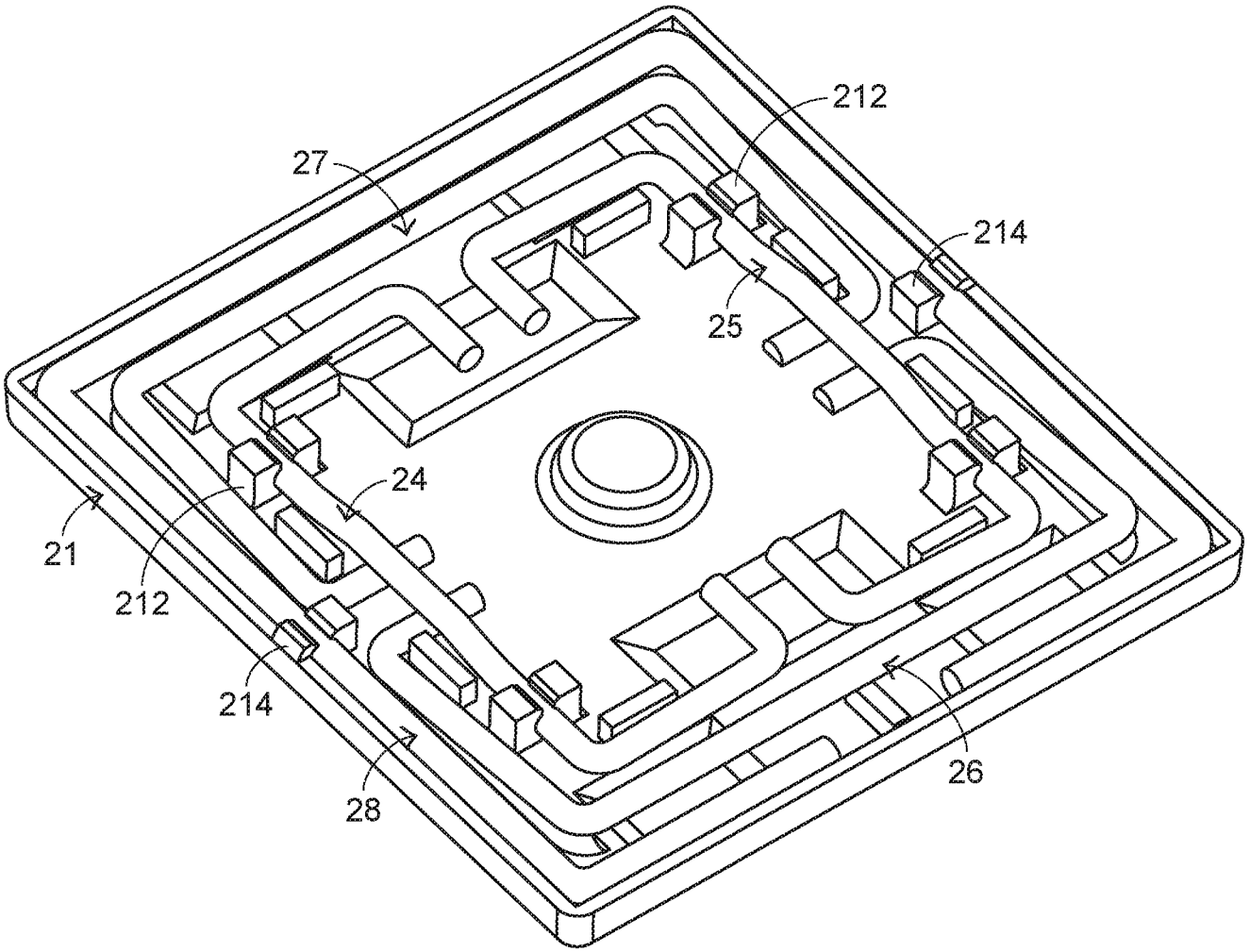
FIG. 5 is a schematic assembled view illustrating a portion of the key structure according to the embodiment of the present invention and taken along another viewpoint, in which the base is not shown.

FIG. 4 is a schematic assembled view illustrating a portion the key structure according to the embodiment of the present invention, in which the keycap is not shown. FIG. 5 is a schematic assembled view illustrating a portion of the key structure according to the embodiment of the present invention and taken along another viewpoint, in which the base is not shown. Please refer to FIGS. 2, 4 and 5. The first longitudinal bar 24 is connected with the keycap 21 and the base 20. Moreover, the first longitudinal bar 24 is located at a first side of the corresponding keycap 21. In this embodiment, the first longitudinal bar 24 comprises plural first coupling segments 241, a first concave segment 242 and plural second coupling segments 243. The plural first coupling segments 241 are located at a first end 244 of the first longitudinal bar 24 and a second end 245 of the first longitudinal bar 24. The plural first coupling segments 241 are coupled with the corresponding first base hooks 201 of the base 20. The first concave segment 242 is located at a middle region of the first longitudinal bar 24. The first concave segment 242 is overlapped and contacted with the first transverse bar 26 and the second transverse bar 27. The plural second coupling segments 243 are on bilateral sides of the first concave segment 242, respectively. Moreover, the plural second coupling segments 243 are coupled with the corresponding first keycap hooks 212 of the keycap 21. In this embodiment, the plural first coupling segments 241, the first concave segment 242 and the plural second coupling segments 243 are integrally formed with the first longitudinal bar 24, and are made of a metallic material. Moreover, the first longitudinal bar 24 is substantially C-shaped.

Similarly, the second longitudinal bar 25 is connected with the keycap 21 and the base 20. Moreover, the second longitudinal bar 25 is located at a second side of the corresponding keycap 21. In this embodiment, the second longitudinal bar 25 comprises plural third coupling segments 251, a second concave segment 252 and plural fourth coupling segments 253. The plural third coupling segments 251 are located at a first end 254 of the second longitudinal bar 25 and a second end 255 of the second longitudinal bar 25. The plural third coupling segments 251 are coupled with the corresponding first base hooks 201 of the base 20. The second concave segment 252 is located at a middle region of the second longitudinal bar 25. The second concave segment 252 is overlapped and contacted with the first transverse bar 26 and the second transverse bar 27. The plural fourth coupling segments 253 are on bilateral sides of the second concave segment 252, respectively. Moreover, the plural fourth coupling segments 253 are coupled with the corresponding first keycap hooks 212 of the keycap 21. In this embodiment, the plural third coupling segments 251, the second concave segment 252 and the plural fourth coupling segments 253 are integrally formed with the second longitudinal bar 25, and are made of a metallic material. Moreover, the second longitudinal bar 25 is substantially C-shaped. However, the entrance of the C-shape of the second longitudinal bar 25 faces the entrance of the C-shape of first longitudinal bar 24.

The first transverse bar 26 is connected with the keycap 21 and the base 20. Moreover, the first transverse bar 26 is located at a third side of the keycap 21. A first end 261 of the first transverse bar 26 is overlapped with the first concave segment 242 of the first longitudinal bar 24. A second end 262 of the first transverse bar 26 is overlapped with the second concave segment 252 of the second longitudinal bar 25. In this embodiment, the first transverse bar 26 comprises plural fifth coupling segments 263 and plural sixth coupling segments 264. The plural fifth coupling segments 263 are located near a middle region of the first transverse bar 26. Moreover, the plural fifth coupling segments 263 are coupled with the corresponding second base hooks 202 of the base 20. The plural sixth coupling segments 264 are located at the first end 261 of the first transverse bar 26 and the second end 262 of the first transverse bar 26. Moreover, the plural sixth coupling segments 264 are partially inserted into the corresponding receiving grooves 213 of the keycap 21. In this embodiment, the first end 261 of the first transverse bar 26, the second end 262 of the first transverse bar 26, the plural fifth coupling segments 263 and the plural sixth coupling segments 264 are integrally formed with the first transverse bar 26, and are made of a metallic material. Moreover, the first transverse bar 26 is substantially C-shaped.

Similarly, the second transverse bar 27 is connected with the keycap 21 and the base 20. Moreover, the second transverse bar 27 is located at a fourth side of the keycap 21. A first end 271 of the second transverse bar 27 is overlapped with the first concave segment 242 of the first longitudinal bar 24. A second end 272 of the second transverse bar 27 is overlapped with the second concave segment 252 of the second longitudinal bar 25. In this embodiment, the second transverse bar 27 comprises plural seventh coupling segments 273 and plural eighth coupling segments 274. The plural seventh coupling segments 273 are located near a middle region of the second transverse bar 27. Moreover, the plural seventh coupling segments 273 are coupled with the corresponding second base hooks 202 of the base 20. The plural eighth coupling segments 274 are located at the first end 271 of the second transverse bar 27 and the second end 272 of the second transverse bar 27. Moreover, the plural eighth coupling segments 274 are partially inserted into the corresponding receiving grooves 213 of the keycap 21. In this embodiment, the first end 271 of the second transverse bar 27, the second end 272 of the second transverse bar 27, the plural seventh coupling segments 273 and the plural eighth coupling segments 274 are integrally formed with the second transverse bar 27, and are made of a metallic material. Moreover, the second transverse bar 27 is substantially C-shaped. However, the entrance of the C-shape of the second transverse bar 27 faces the entrance of the C-shape of the first transverse bar 26.

The operations of the key structure 2 in response to the depressing action of the user will be illustrated as follows. When the keycap 21 is depressed by the user, the keycap 21 is moved downwardly to push the first transverse bar 26 and the second transverse bar 27 in response to the depressing force. Consequently, the plural sixth coupling segments 264 of the first transverse bar 26 and the plural eighth coupling segments 274 of the second transverse bar 27 are rotated in the corresponding receiving grooves 213 of the keycap 21. Moreover, the plural fifth coupling segments 263 of the first transverse bar 26 and the plural seventh coupling segments 273 of the second transverse bar 27 are rotated in the second base hooks 202 of the base 20. That is, the first concave segment 242 of the first longitudinal bar 24 and the second concave segment 252 of the second longitudinal bar 25 are pushed by the first transverse bar 26 and the second transverse bar 27. Consequently, the plural first coupling segments 241 of the first longitudinal bar 24 and the plural third coupling segments 251 of the second longitudinal bar 25 are rotated in the corresponding first base hooks 201 of the base 20, and the plural second coupling segments 243 of the first longitudinal bar 24 and the plural fourth coupling segments 253 of the second longitudinal bar 25 are rotated in the corresponding first keycap hooks 212 of the keycap 21. As the first longitudinal bar 24, the second longitudinal bar 25, the first transverse bar 26 and the second transverse bar 27 are cooperatively swung, all regions of the keycap 21 are driven by the first longitudinal bar 24, the second longitudinal bar 25, the first transverse bar 26 and the second transverse bar 27. Consequently, the keycap 21 can be moved downwardly relative to the base 20 more stably.

Figure 6:
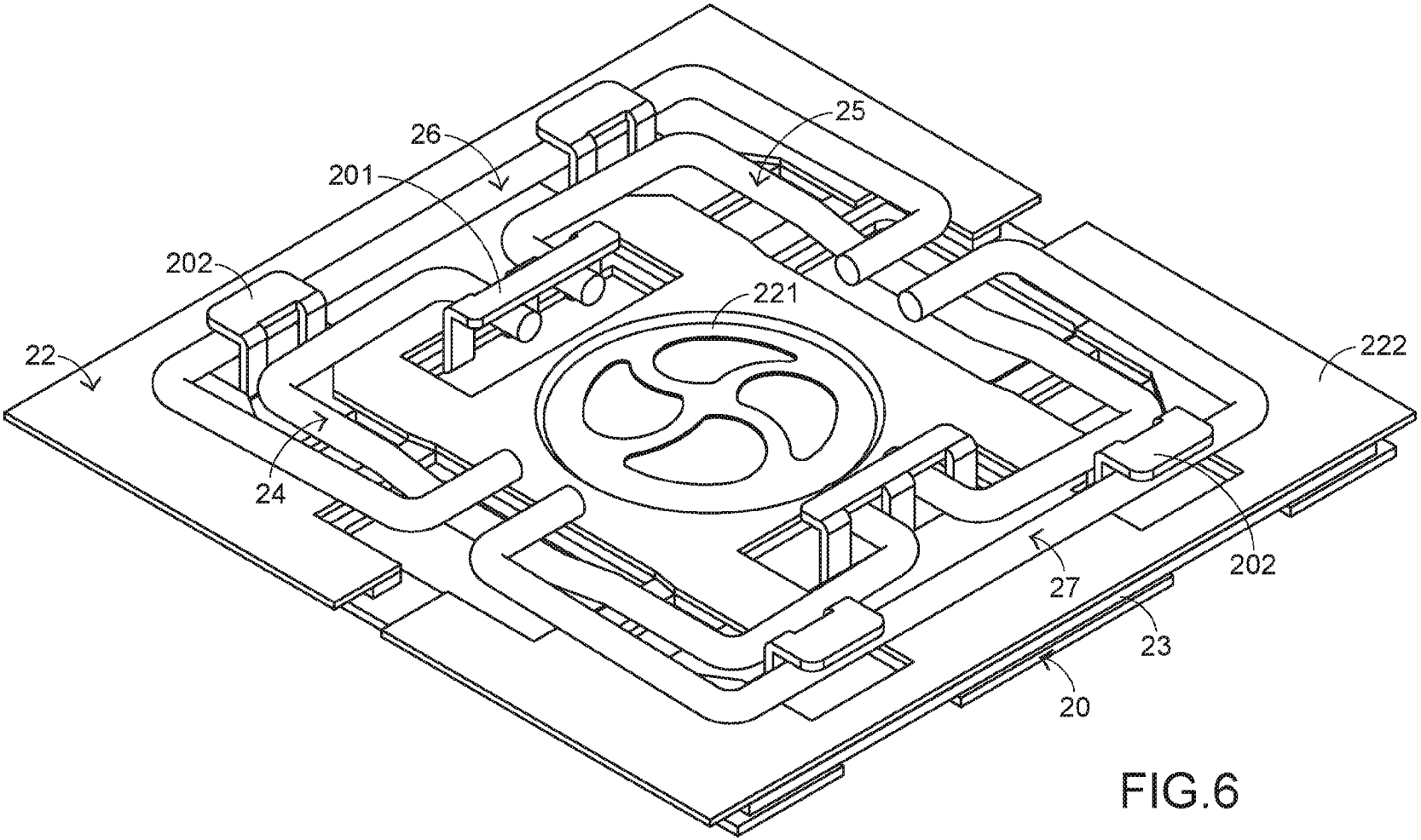
FIG. 6 is a schematic assembled view illustrating a portion the key structure according to the embodiment of the present invention, in which the keycap is depressed and the keycap is not shown.

FIG. 6 is a schematic assembled view illustrating a portion the key structure according to the embodiment of the present invention, in which the keycap is depressed and the keycap is not shown. As the keycap 21 is moved downwardly, the keycap 21 pushes the corresponding elastic element 22. At the same time, the rubbery elastomer 221 of the elastic element is subjected to deformation to push the membrane switch circuit member 23 and trigger the corresponding key intersection (not shown) of the membrane switch circuit member 23. Consequently, the membrane switch circuit member 23 generates a corresponding key signal.

When the keycap 21 is no longer depressed by the user, no external force is applied to the keycap 21, and the rubbery elastomer 22 is no longer pushed by the keycap 21. In response to the elasticity of the rubbery elastomer 221, the rubbery elastomer 221 is restored to its original shape to provide an upward elastic restoring force. Consequently, the keycap 21 is returned to its original position where it is not depressed. At the same time, the first transverse bar 26 and the second transverse bar 27 are pushed by the first concave segment 242 of the first longitudinal bar 24 and the second concave segment 252 of the second longitudinal bar 25. As the first longitudinal bar 24, the second longitudinal bar 25, the first transverse bar 26 and the second transverse bar 27 are cooperatively swung, the keycap 21 is returned to the original position where it is not depressed.

Figure 7:
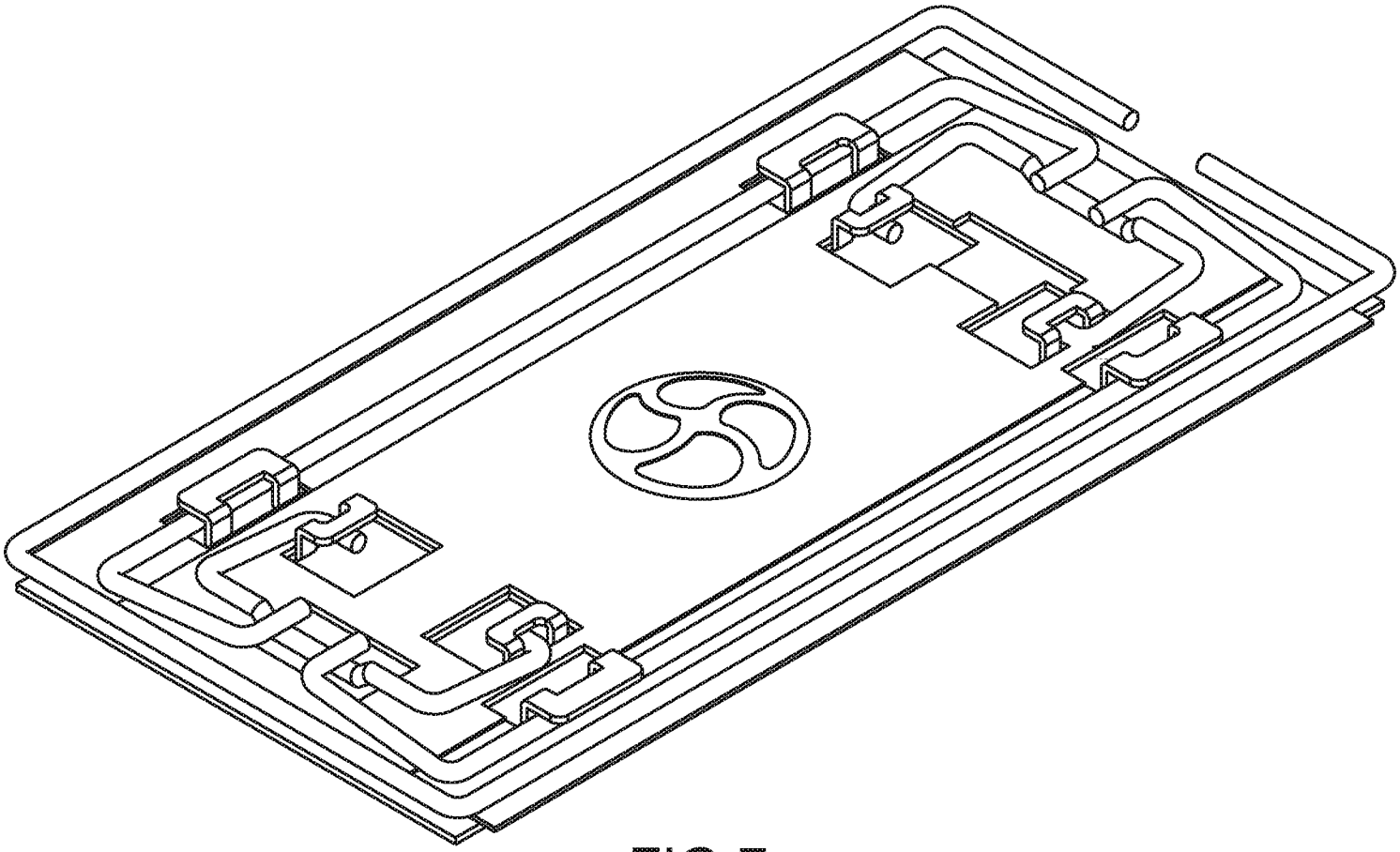
FIG. 7 is a schematic assembled view illustrating a portion a larger-sized key structure according to another embodiment of the present invention, in which the keycap is not shown.

In the above embodiment, the key structure has the ordinary size. For example, the key structure is the alphabetic "A" key. It is noted that the example of the key structure is not restricted. For example, in another embodiment, the key structure is a larger-sized key (e.g., the "Enter" key). FIG. 7 is a schematic assembled view illustrating a portion a larger-sized key structure according to another embodiment of the present invention, in which the keycap is not shown. The structures and functions of the larger-sized key structure are similar to those of the above key structure, and are not redundantly described herein.

From the above descriptions, the present invention provides the key structure. The first longitudinal bar, the second longitudinal bar, the first transverse bar and the second transverse bar are made of a metallic material. Moreover, the first longitudinal bar, the second longitudinal bar, the first transverse bar and the second transverse bar are uniformly distributed in the range of the keycap in order to replace the scissors-type connecting element of the conventional key structure. Since the first longitudinal bar, the second longitudinal bar, the first transverse bar and the second transverse bar are thinner than the scissors-type connecting element of the conventional key structure, the key structure of the present invention has reduced thickness. Consequently, the key structure has slim appearance. Moreover, since the first longitudinal bar, the second longitudinal bar, the first transverse bar and the second transverse bar are made of the metallic material, the structural strength of the key structure is increased. In other words, the use of the key structure of present invention can overcome the drawbacks of the conventional technologies.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a base;

a keycap disposed over the base, and movable relative to the base;

a first longitudinal bar connected with the keycap and the base, and located at a first side of the keycap;

a second longitudinal bar connected with the keycap and the base, and located at a second side of the keycap;

a first transverse bar connected with the keycap and the base, and located at a third side of the keycap, wherein a first end of the first transverse bar is overlapped with the first longitudinal bar, and a second end of the first transverse bar is overlapped with the second longitudinal bar; and a second transverse bar connected with the keycap and the base, and located at a fourth side of the keycap, wherein a first end of the second transverse bar is overlapped with the first longitudinal bar, and a second end of the second transverse bar is overlapped with the second longitudinal bar, wherein while the keycap is depressed, the first transverse bar and the second transverse bar are pushed by the keycap, and the first longitudinal bar and the second longitudinal bar are pushed by the first transverse bar and the second transverse bar, so that the keycap is moved relative to the base.

2. The key structure according to claim 1, wherein the first longitudinal bar comprises:

plural first coupling segments located at a first end and a second end of the first longitudinal bar, wherein the plural first coupling segments are coupled with the base;

a first concave segment located at a middle region of the first longitudinal bar, wherein the first concave segment is overlapped and contacted with the first transverse bar and the second transverse bar; and plural second coupling segments, wherein the plural second coupling segments are on bilateral sides of the first concave segment, respectively, wherein the plural second coupling segments are coupled with the keycap, wherein when the keycap is depressed, the first concave segment of the first longitudinal bar and a second concave segment of the second longitudinal bar are pushed by the first transverse bar and the second transverse bar, respectively.

3. The key structure according to claim 2, wherein the base comprises plural first base hooks, wherein the plural first base hooks are protruded from a surface of the base, and are coupled with the corresponding first coupling segments, wherein when the plural first coupling segments are rotated in the corresponding first base hooks and relative to the base, the first longitudinal bar is swung.

4. The key structure according to claim 2, wherein the keycap comprises plural keycap hooks, wherein the plural keycap hooks are protruded from an inner surface of the keycap, and coupled with the corresponding second coupling segments, wherein when the plural second coupling segments are rotated in the corresponding keycap hooks and relative to the keycap, the first longitudinal bar is swung.

5. The key structure according to claim 1, wherein the second longitudinal bar comprises:

plural third coupling segments located at a first end and a second end of the second longitudinal bar, wherein the plural third coupling segments are coupled with corresponding base hooks of the base;

a second concave segment located at a middle region of the second longitudinal bar, wherein the second concave segment is overlapped and contacted with the first transverse bar and the second transverse bar; and plural fourth coupling segments, wherein the plural fourth coupling segments are on bilateral sides of the second concave segment, respectively, wherein the plural fourth coupling segments are coupled with corresponding keycap hooks of the keycap.

6. The key structure according to claim 1, wherein the first transverse bar comprises:

plural fifth coupling segments located near a middle region of the first transverse bar, wherein the plural fifth coupling segments are coupled with corresponding base hooks of the base; and plural sixth coupling segments located at a first end and a second end of the first transverse bar, wherein the plural sixth coupling segments are partially inserted into the keycap.

7. The key structure according to claim 6, wherein the base comprises plural second base hooks, wherein the plural second base hooks are protruded from a surface of the base, and are coupled with the corresponding fifth coupling segments.

8. The key structure according to claim 6, wherein the keycap comprises plural receiving grooves, and the plural receiving grooves are formed in an inner surface of the keycap, wherein the plural sixth coupling segments are partially inserted into the corresponding receiving grooves, wherein when the plural sixth coupling segments are rotated in the corresponding receiving grooves and relative to the keycap, the first transverse bar is swung.

9. The key structure according to claim 1, wherein the second transverse bar comprises:

plural seventh coupling segments located near a middle region of the second transverse bar, wherein the plural seventh coupling segments are coupled with corresponding base hooks of the base; and plural eighth coupling segments located at a first end and a second end of the second transverse bar, wherein the plural eighth coupling segments are partially inserted into the keycap.

10. The key structure according to claim 1, further comprising a surrounding bar, wherein the surrounding bar is connected with the keycap, and the surrounding bar surrounds a periphery region of the keycap, so that a structural strength of the keycap is increased.

11. The key structure according to claim 1, further comprising:

a membrane switch circuit member disposed on the base, wherein as the keycap is moved to trigger the membrane switch circuit member, a key signal corresponding to the keycap is outputted from the membrane switch circuit member; and an elastic element arranged between the keycap and the membrane switch circuit member, wherein when the elastic element is pushed by the keycap, the membrane switch circuit member is triggered, wherein when the keycap is not depressed, the elastic element provides an elastic force, wherein the first transverse bar and the second transverse bar are pushed by the first longitudinal bar and the second longitudinal bar in response to the elastic force, so that the keycap is moved upwardly relative to the base.

* * * * *